US012352195B2

(12) United States Patent
Osuga

(10) Patent No.: US 12,352,195 B2
(45) Date of Patent: Jul. 8, 2025

(54) METHOD FOR MANUFACTURING EXHAUST COMPONENT

(71) Applicant: FUTABA INDUSTRIAL CO., LTD., Aichi (JP)

(72) Inventor: Fumitaka Osuga, Aichi (JP)

( * ) Notice: Subject to any disclaimer, the term of this patent is extended or adjusted under 35 U.S.C. 154(b) by 0 days.

(21) Appl. No.: 18/969,780

(22) Filed: Dec. 5, 2024

(65) Prior Publication Data

US 2025/0188862 A1 Jun. 12, 2025

(30) Foreign Application Priority Data

Dec. 7, 2023 (JP) ..... 2023-206858

(51) Int. Cl.
*B60R 13/08* (2006.01)
*F01N 13/18* (2010.01)

(52) U.S. Cl.
CPC ..... *F01N 13/185* (2013.01); *F01N 13/1888* (2013.01); *F01N 2450/20* (2013.01); *Y10T 29/49398* (2015.01)

(58) Field of Classification Search
CPC ..... F01N 13/185; F01N 13/1888; F01N 2450/20; Y10T 29/49398
See application file for complete search history.

(56) References Cited

U.S. PATENT DOCUMENTS 4,333,545 A * 6/1982 Roberts ..... F01N 13/185 181/282
6,983,768 B1 * 1/2006 Vujic ..... F16L 59/024 138/119
7,273,649 B2 * 9/2007 Miwa ..... F01N 3/2853 428/116
7,823,285 B2 * 11/2010 Cai ..... F01N 3/2853 422/177
10,899,292 B2 * 1/2021 Yamamoto ..... B60R 13/0876
11,125,137 B2 * 9/2021 Yamamoto ..... F01N 13/1888
2007/0116617 A1 * 5/2007 Lawrukovich ..... F01N 13/1888 422/179
2019/0161029 A1 5/2019 Yamamoto et al.

FOREIGN PATENT DOCUMENTS

JP 2019094852 A 6/2019

* cited by examiner

*Primary Examiner* — Ryan J. Walters
(74) *Attorney, Agent, or Firm* — David D. Brush; Westman, Champlin & Koehler, P.A.

(57) ABSTRACT

Provided is a method for manufacturing an automotive exhaust component. The method includes joining first and second members included in an insulator. The first member includes: a first main body; a first joining portion located at an end of the first main body; and a first positioner provided to the first joining portion. The second member includes: a second main body; a second joining portion located at an end of the second main body; and two second positioners provided to the second joining portion. Once the first and second members are in position, the first joining portion faces the second joining portion, and the first positioner is situated between the two second positioners. The first and second joining portions are swaged with each other thereafter.

9 Claims, 4 Drawing Sheets

METHOD FOR MANUFACTURING EXHAUST COMPONENT

CROSS-REFERENCE TO RELATED APPLICATIONS

This application claims the benefit of Japanese Patent Application No. 2023-206858 filed on Dec. 7, 2023 with the Japan Patent Office, the entire disclosure of which is incorporated herein by reference.

BACKGROUND

The present disclosure relates to a method for manufacturing an exhaust component.

There has been known an insulator that covers an outer-circumferential surface of a part of a vehicle such as a catalytic converter. An insulator disclosed in Japanese Unexamined Patent Application Publication No. 2019-94852 comprises an upper member and a lower member, each of which has a semicircular cross-section. To join the upper member and the lower member, these members are firstly arranged so as to hold the catalytic converter from top and bottom. Then flanges of the members are swaged with each other to form a V shape, and the members are thus joined together. The insulator is thereby formed.

SUMMARY

However, in the technique disclosed in Japanese Unexamined Patent Application Publication No. 2019-94852, deviation of the upper member and the lower member in a direction of an axis of the catalytic converter may be caused in a process where these members are joined.

In one aspect of the present disclosure, it is desirable that positioning of the members in forming the insulator is performed more easily.

One aspect of the present disclosure provides a method for manufacturing an automotive exhaust component. The method comprises: arranging first and second members so as to be located on both sides of a flow path member, the first and second members each having a plate shape and being included in an insulator that surrounds the flow path member, the flow path member extending along an axial line and being provided with a path for exhaust gas therein; and joining the first and second members. The first member includes: a first main body; a first joining portion; and a first positioner. The first main body is arranged to face an outer-circumferential surface of the flow path member. The first joining portion has a flange shape and is provided at an end of the first main body in a circumferential direction about the axial line. The first positioner is provided to the first joining portion. The second member includes: a second main body; a second joining portion; and two second positioners. The second main body is arranged to face the outer-circumferential surface of the flow path member. The second joining portion has a flange shape and is provided at an end of the second main body in the circumferential direction. The two second positioners are provided to the second joining portion and aligned in a direction of the axial line. Once the first and second members are in position, the first joining portion faces the second joining portion, and the first positioner is situated between the two second positioners. The first and second joining portions are swaged with each other, and the first and second members are thus joined. The first positioner is provided at an end of the first joining portion opposite to the first main body and has a plate shape protruding toward the second joining portion.

Such configuration facilitates arrangement of the first positioner between the two second positioners when the first and second members are arranged in position. Positioning of the first and second members in forming the insulator is thus more easily performed.

In one aspect of the present disclosure, the two second positioners may be provided at an end of the second joining portion opposite to the second main body, and each may have a plate shape protruding toward the first joining portion.

Such configuration facilitates arrangement of the first positioner between the two second positioners when the first and second members are arranged in position. Positioning of the first and second members in forming the insulator is thus more easily performed.

In one aspect of the present disclosure, the method may further comprise, after the first and second members are placed, folding the first positioner and the two second positioners toward the first and second main bodies so as to overlap with the first and second joining portions.

With this configuration, it is possible to reduce hindrance to works, such as manufacturing of the exhaust component or attachment of the exhaust component, that is caused by the first positioner and the two second positioners.

In one aspect of the present disclosure, when the first and second members are joined together, the first and second joining portions may be swaged with the folded first positioner and the two folded second positioners.

With this configuration, it is possible to appropriately join the first and second members.

In one aspect of the present disclosure, after the first and second members are placed, the first positioner may be folded toward the first and second main bodies so as to overlap with the first and second joining portions.

With this configuration, it is possible to reduce hindrance to works, such as manufacturing of the exhaust component or attachment of the exhaust component, that is caused by the first positioner.

In one aspect of the present disclosure, when the first and second members are joined together, the first and second joining portions may be swaged with the folded first positioner.

With this configuration, the first and second members are appropriately joined.

The method comprises: arranging first and second members so as to be located on both sides of a flow path member, the first and second members each having a plate shape and being included in an insulator that surrounds the flow path member, the flow path member extending along an axial line and being provided with a path for exhaust gas therein; and joining the first and second members. The first member includes: a first main body; a first joining portion; and a first positioner. The first main body is arranged to face an outer-circumferential surface of the flow path member. The first joining portion has a flange shape and is provided at an end of the first main body in a circumferential direction about the axial line. The first positioner is provided to the first joining portion. The second member includes: a second main body; a second joining portion; and two second positioners. The second main body is arranged to face the outer-circumferential surface of the flow path member. The second joining portion has a flange shape and is provided at an end of the second main body in the circumferential direction. The two second positioners are provided to the second joining portion and aligned in a direction of the axial line. Once the first and second members are in position, the first joining portion faces the second joining portion, and the first positioner is situated between the two second positioners. The first and second joining portions are swaged with each other, and the first and second members are thus joined. The two second positioners are provided at an end of the second joining portion opposite to the second main body and each has a plate shape protruding toward the first joining portion.

Such configuration facilitates arrangement of the first positioner between the two second positioners when the first and second members are arranged in position. Positioning of the first and second members in forming the insulator is thus more easily performed.

In one aspect of the present disclosure, after the first and second members are placed, the two second positioners may be folded toward the first and second main bodies so as to overlap with the first and second joining portions.

With this configuration, it is possible to reduce hindrance to works, such as manufacturing of the exhaust component or attachment of the exhaust component, that is caused by the two second positioners.

In one aspect of the present disclosure, when the first and second members are joined together, the first and second joining portions may be swaged with the folded two second positioners.

With this configuration, the first and second members are appropriately joined.

BRIEF DESCRIPTION OF THE DRAWINGS

Example embodiments of the present disclosure will be described hereinafter with reference to the accompanying drawings, in which.

DETAILED DESCRIPTION OF THE PREFERRED EMBODIMENTS

1. First Embodiment

(1) Overview

Figure 1:
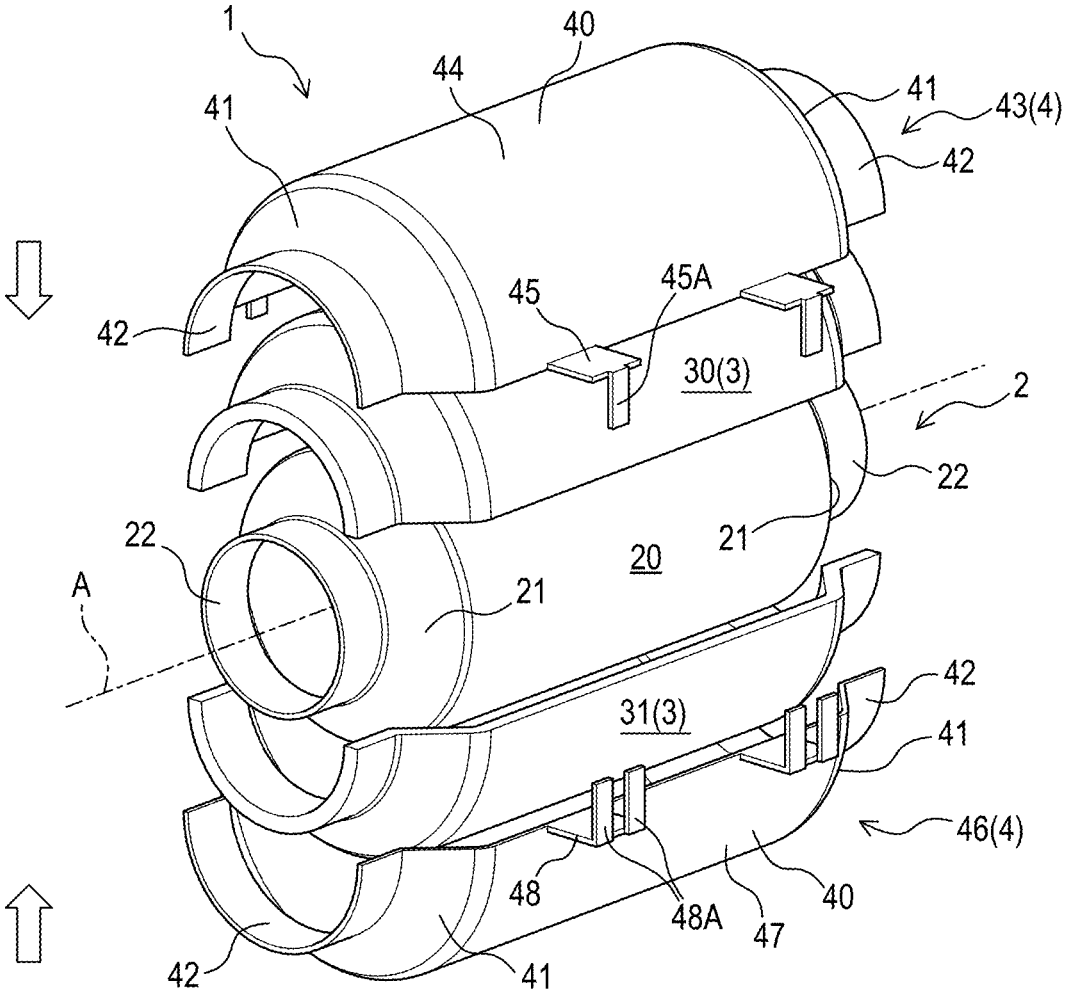
FIG. 1 is an explanatory diagram of a placement process in a first embodiment.

A purification device 1 of a first embodiment is one example of an exhaust component that causes exhaust gas from a automotive engine to flow downstream (see FIG. 1). The purification device 1 is installed in a vehicle and configured to purify exhaust gas, in one example, with the use of a catalyst. The purification device 1 comprises: a catalyst case 2; a heat insulating material 3; and an insulator 4.

The catalyst case 2 has a cylindrical shape extending along an axis A and is configured as a flow path member inside which a path for exhaust gas is formed. There is a not shown catalyst that is arranged inside the catalyst case 2, and exhaust gas flows downstream along a direction of the axis A inside the catalyst case 2. The axis A passes through a substantial center of a cross-section of the catalyst case 2, which is perpendicular to the axis A (hereinafter, simply referred to as a cross-section). The catalyst case 2 includes: a center portion 20; two tapered portions 21; and two openings 22.

The center portion 20 has a cylindrical shape with a substantially constant cross-sectional area.

The two tapered portions 21 are situated adjacent to both ends of the center portion 20 in the direction of the axis A. The tapered portions 21 are slanted such that cross-sections thereof decrease as being away from the center portion 20.

The two openings 22 are located at both ends of the catalyst case 2, and each has a cylindrical shape with a substantially constant cross-sectional area. These openings 22 are adjacent to the tapered portions 21 and form an inlet and an outlet for the exhaust gas in the catalyst case 2.

The heat insulating material 3 is arranged between the catalyst case 2 and the insulator 4 and has a heat insulating property and a cushioning property. The heat insulating material 3 may be made of a material, in one example, alumina fiber, glass wool or the like. The heat insulating material 3 includes a first portion 30 and a second portion 31, each having a semicircular cross-section. The heat insulating material 3 is, in one example, arranged to abut an entire outer-circumferential surface of the catalyst case 2 and an entire inner-circumferential surface of the insulator 4 and to fill a space between the catalyst case 2 and the insulator 4. The heat insulating material 3 may be formed, for example, into a tubular shape by rolling a plate-shaped material.

(2) Insulator

The insulator, which has a tubular shape, is arranged to surround the outer-circumferential surface of the catalyst case 2 and suppresses heat radiation from the catalyst case 2 (see FIG. 1). In one example, the insulator 4 has a cylindrical shape and is arranged to face the entire outer-circumferential surface of the catalyst case 2. There is an interspace with a substantially constant thickness provided between the catalyst case 2 and the insulator 4. Without being limited to this arrangement, the insulator 4 may be arranged to face a part of the outer-circumferential surface of the catalyst case 2. The insulator 4 is formed not only in a cylindrical shape but may also have various shapes. As previously described, the heat insulating material 3 is arranged in the interspace between the insulator 4 and the catalyst case 2. However, the heat insulating material 3 is not necessarily arranged in the interspace.

The insulator 4 includes: a center portion 40; two tapered portions 41; and two openings 42.

The center portion 40 faces an outer-circumferential surface of the center portion 20 of the catalyst case 2 and has a cylindrical shape with a substantially constant cross-sectional area.

The two tapered portions 41 each faces an outer-circumferential surface of each of the tapered portions 21 of the catalyst case 2 and is slanted such that a cross-section thereof decreases as being away from the center portion 40.

The two openings 42 each faces an outer-circumferential surface of each of the openings 22 in the catalyst case 2 and has a cylindrical shape with a substantially constant cross-sectional area.

The insulator 4 includes first and second members 43, 46, each of which is a plate-shaped member with a semicircular cross-section. These members are joined together with their inner circumferential surfaces facing each other, to thereby form the insulator 4.

(3) First and Second Joining Portions

Figure 2:
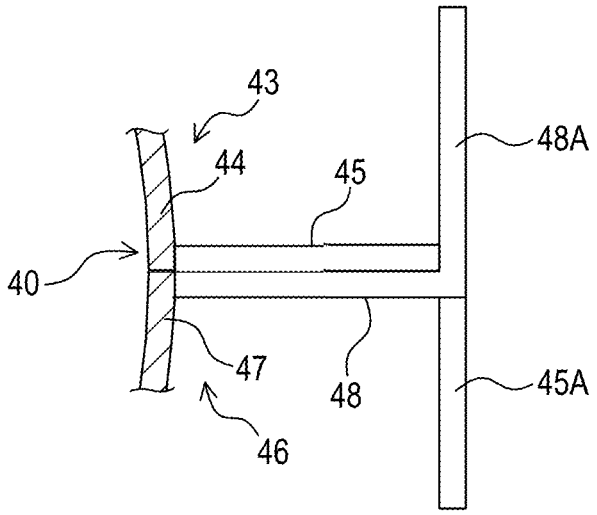
FIG. 2 is a side view of first and second joining portions and first and second positioners arranged in the placement process in the first embodiment, as seen along a direction of an axial line.
Figure 3:
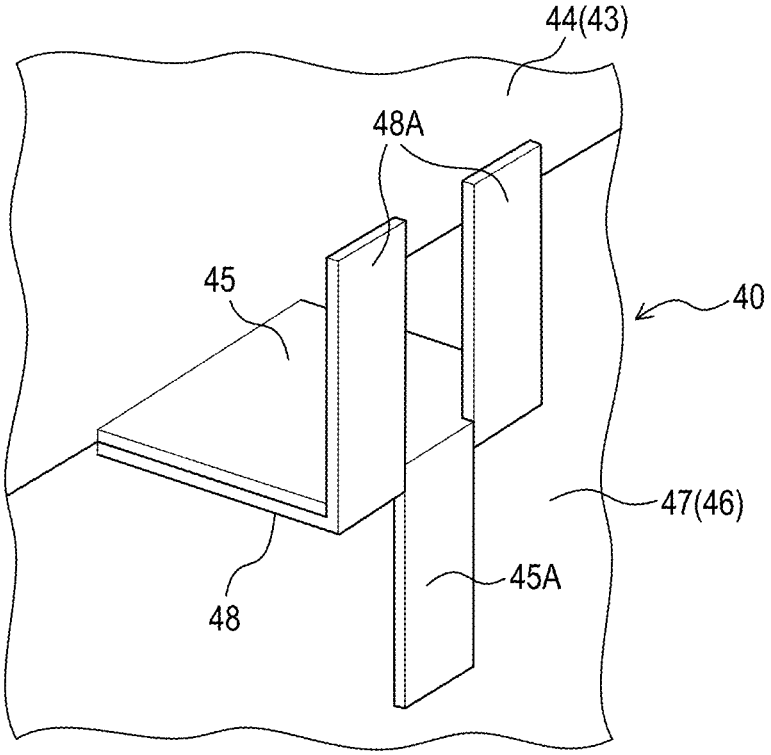
FIG. 3 is a perspective view of the first and second joining portions and the first and second positioners arranged in the placement process in the first embodiment.

The first member 43 includes a first main body 44 and at least one (in one example, four) first joining portion 45 (see FIGS. 1 to 3).

The first main body 44 faces the outer-circumferential surface of the catalyst case 2.

Each first joining portion 45 has a flange shape and is provided at an end of the first main body 44 in a circumferential direction about the axis A (hereinafter, simply referred to as a circumferential direction).

Likewise, the second member 46 includes a second main body 47 and a second joining portions 48, which are configured similarly to the first main body 44 and the first joining portion 45 of the first member 43, respectively, and the second joining portions 48, which are provided as many in number as the first joining portion 45.

Hereinafter, each of the first and second main bodies 44, 47 will be simply also referred to as a main body, and each of the first and second joining portions 45, 48 will be simply also referred to as a joining portion.

Each joining portion is a plate-shaped portion, and in one example, has a rectangular shape extending in the direction of the axis A. Two joining portions are provided in each main body at edges forming both ends in the circumferential direction. Each first joining portion 45 and each second joining portion 48 are arranged to face each other, and the first and second joining portions 45, 48 in facing relation are swaged, to thereby join the first and second members 43, 44, the details of which will be described later.

Further, the first joining portion 45 is provided with a first positioner 45A, which has a plate shape, at an end opposite to the first main body 44. The first positioner 45A is located substantially in a middle of the first joining portion 45 in the direction of the axis A. The first joining portion 45 together with the first positioner 45A forms an L-shape as seen in the direction of the axis A, and the first positioner 45A projects toward the second joining portion 48 (in other words, toward the second member 46).

Likewise, the second joining portion 48 is provided with two second positioners 48A, each of which has a plate shape, at an end opposite to the second main body 47. These second positioners 48A are aligned in the direction of the axis A with a distance substantially in a middle of the second joining portion 48 in the direction of the axis A. The second joining portion 48 together with each of the second positioners 48A forms an L-shape as seen in the direction of the axis A, and each second positioner 48A projects toward the first joining portion 45 (in other words, toward the first member 43).

An angle formed by the first joining portion 45 and the first positioner 45A and an angle formed by the second joining portion 48 and each second positioner 48A are substantially 90 degrees in one example, but not limited thereto, and each of these angles may be appropriately determined. Hereinafter, each of the first and second positioners 45A, 48A will be also simply referred to as a positioner.

(4) Method for Manufacturing Purification Device

The method for manufacturing the purification device 1 comprises: a placement process; a folding process; and a joining process. Through these processes, the insulator 4 is attached to the catalyst case 2.

In the placement process, the first and second members 43, 46 are arranged to be located on both sides of the catalyst case 2 (see FIG. 1). At the same time, the first portion 30 of the heat insulating material 3 is arranged between the first member 43 and the catalyst case 2, and the second portion 31 of the heat insulating material 3 is arranged between the second member 46 and the catalyst case 2. In one example, the first and second members 43, 46 are located on an upper side and on a lower side, respectively, and these members face each other in the up-down direction. However, positions where these members are located or the direction in which they face may be appropriately determined.

Specifically, inner-circumferential surfaces of the first and second members 43, 46 face the catalyst case 2. Portions of the first and second members 43, 46 that correspond to the center portion 40, each tapered portion 41, and each opening 42 face the center portion 20, each tapered portion 21, and each opening 22 of the catalyst case 2, respectively.

At the same time, each first joining portion 45 of the first member 43 faces each second joining portion 48 of the second member 46 (see FIGS. 2, 3). The two facing joining portions may be in contact with each other, or there may be a small distance between these joining portions.

The first positioner 45A of each first joining portion 45 is arranged between the two second positioners 48A of the second joining portion 48, which faces the first joining portion 45 (see FIG. 3). Specifically, in the first positioner 45A, both ends in the direction of the axis A are in contact with the second positioners 48A, or there is/are a small distance(s) provided between the both ends and the second positioners 48A. In this state, each first positioner 45A and each second positioner 48A extend along a direction approximately corresponding to a direction in which the first and second members 43, 46 face each other.

Figure 4:
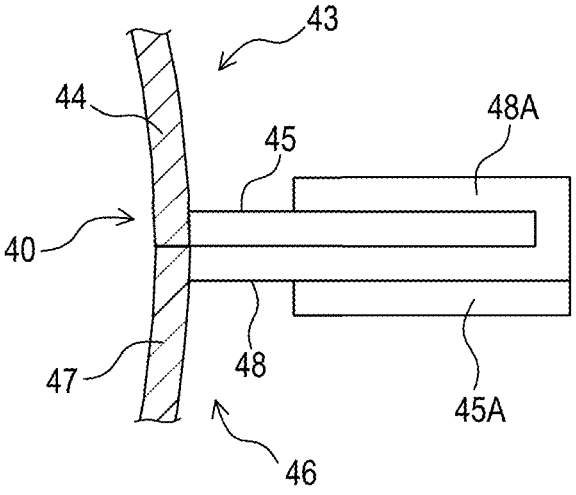
FIG. 4 is a side view of the first and second positioners folded in a folding process in the first embodiment, as seen along the direction of the axial line.

In the subsequent folding process, each first positioner 45A and each second positioner 48A are folded toward the main body (see FIG. 4). Consequently, each first positioner 45A overlaps the first and second joining portions 45, 48, and each second positioner 48A also overlaps the first and second joining portions 45, 48. At the same time, the positioners and the joining portions overlapping with one another may be in contact or may have a small distance(s) therebetween.

Figure 5:
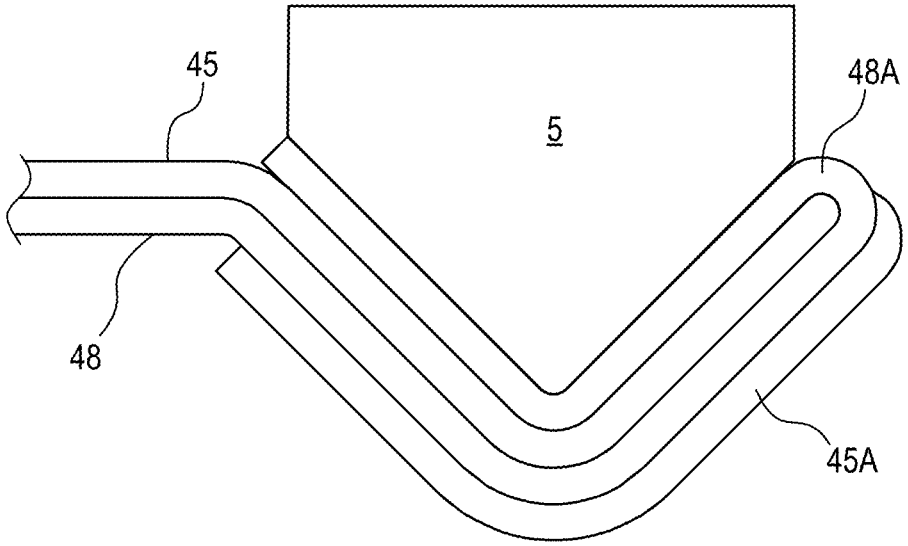
FIG. 5 is an explanatory diagram of a joining process in the first embodiment.
Figure 6:
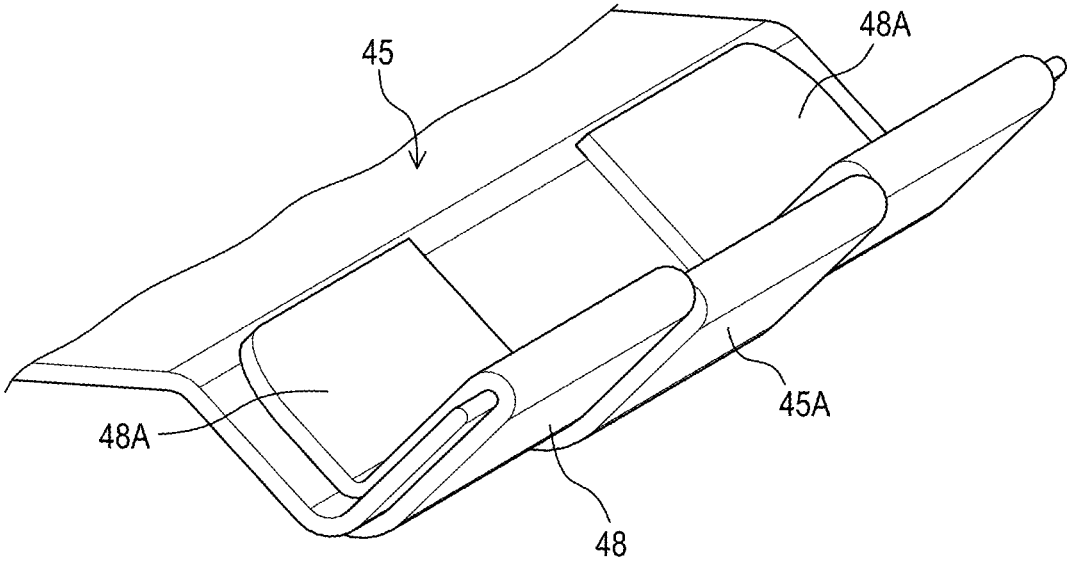
FIG. 6 is a perspective view of the first and second joining portions and the first and second positioners swaged in the joining process in the first embodiment.

In the subsequent joining process, the facing first and second joining portions 45, 48 are swaged with the first positioner 45A and the two second positioners 48A, which overlap with the joining portions, and thus these joining portions are joined together (see FIG. 5, 6). In this way, the first and second members 43, 46 are joined, and thus the insulator 4 is formed.

In one example, the overlapping joining portions and positioners are joined together by V-bending. Specifically, the V-bending is performed by pressing these joining portions and positioners with a V-shaped projection of a swager 5. As a matter of course, the swaging method is not limited to this, and these joining portions and positioners may be swaged by using various methods.

2. Second Embodiment

(1) Overview

The purification device 1 in the second embodiment differs from that in the first embodiment in configuration of the joining portions. The differences therebetween will be described below.

(2) First and Second Joining Portions

The first joining portion 45 has a configuration similar to that in the first embodiment and is provided with the first positioner 45A.

Figure 7:
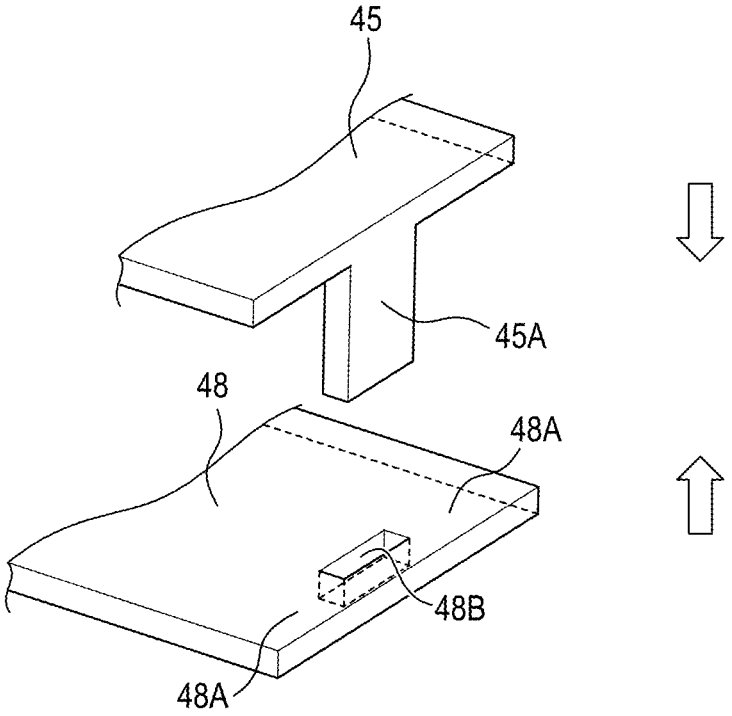
FIG. 7 is an explanatory diagram of a placement process in a second embodiment.

On the other hand, the second joining portion 48 is provided, not with the two second positioners 48A, but with a slit 48B, which is an elongated hole penetrating the second joining portion 48 along an end opposite to the main body (see FIG. 7). The slit 48B is located substantially in the middle of the second joining portion 48 in the direction of the axis A. The slit 48B extends along the direction of the axis A and allows insertion of the first positioner 45A thereinto.

(3) Method for Manufacturing Purification Device

In the placement process, as in the first embodiment, the catalyst case 2, the heat insulating material 3, and the first and second members 43, 46 are arranged, in which, as in the first embodiment, each first joining portion 45 and each second joining portion 48 face each other (see FIG. 1). At the same time, the first positioner 45A of each first joining portion 45 penetrates the slit 48B of the second joining portion 48 and projects from a surface of the second joining portion 48 opposite to the first joining portion 45, the first joining portion 45 being positioned in facing relation with the second joining portion 48.

That is to say, in the second joining portion 48, portions located on both sides of the slit 48B in the direction of the axis A function as the second positioners 48A, and the first positioner 45A is arranged between these second positioners 48A (see FIG. 7).

In the subsequent folding process, each first positioner 45A that penetrates the slit 48B and projects from the surface of the second joining portion 48 opposite to the first joining portion 45 is folded toward the main body. In this way, each first positioner 45A overlaps with the joining portions, as in the first embodiment.

In the subsequent joining process, as in the first embodiment, the facing first and second joining portions 45, 48 are swaged with the first positioner 45A overlapping with these joining portions, and thus the first and second members 43, 46 are joined together.

3. Third Embodiment

(1) Overview

The purification device 1 in the third embodiment differs from that in the first embodiment in configuration of the joining portions. The differences therebetween will be described below.

(2) First and Second Joining Portions

The second joining portion 48 has a configuration similar to that in the first embodiment and is provided with the two second positioners 48A.

Figure 8:
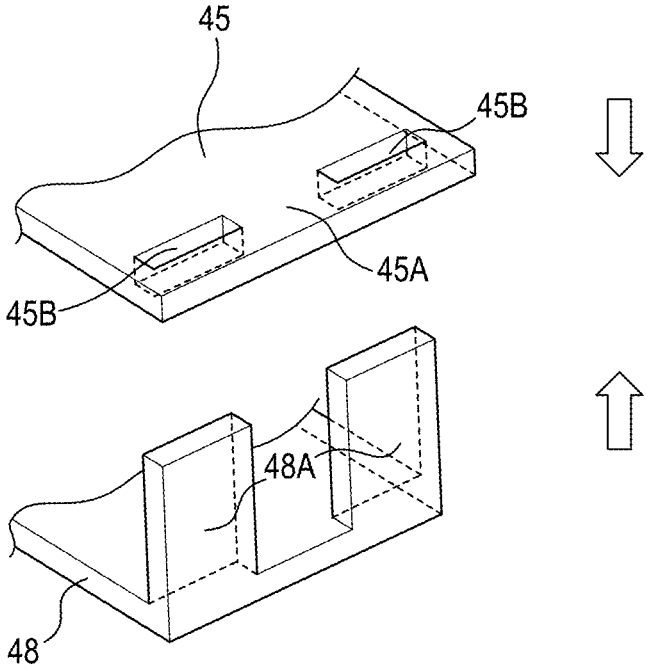
FIG. 8 is an explanatory diagram of a placement process in a third embodiment.

On the other hand, the first joining portion 45 is provided, not with the first positioner 45A, but with two slits 45B, which are elongated holes penetrating the first joining portion 45 along an end opposite to the main body (see FIG. 8). These slits 45B extend along the direction of the axis A and are aligned in the direction of the axis A with a distance substantially in the middle of the first joining portion 45 in the direction of the axis A. Each of these slits 48B allow insertion of each second positioner 48A thereinto.

(3) Method for Manufacturing Purification Device

In the placement process, as in the first embodiment, the catalyst case 2, the heat insulating material 3, and the first and second members 43, 46 are arranged, and, as in the first embodiment, each first joining portion 45 and each second joining portion 48 face each other (see FIG. 1). At the same time, the two second positioners 48A of each second joining portion 48 penetrates each slit 45B of the first joining portion 45 and projects from a surface of the first joining portion 45 opposite to the second joining portion 48, the second joining portion 48 being positioned in facing relation with the first joining portion 45.

That is to say, in the first joining portion 45, a portion located between the two slits 45B functions as the first positioner 45A, and the first positioner 45A is arranged between the two second positioners 48A, each of which penetrates each slit 45B.

In the subsequent folding process, each second positioner 48A, which penetrates each slit 45B and projects from the surface of the first joining portion 45 opposite to the second joining portion 48, is folded toward the main body. In this way, as in the first embodiment, each second positioner 48A overlaps with the joining portion.

In the subsequent joining process, as in the first embodiment, the facing first and second joining portions 45, 48 are swaged with the two second positioners 48A overlapping with these joining portions, and thus the first and second members 43, 46 are joined together.

4. Effects (1) According to the above-described embodiments, at least one of the first joining portion 45 together with the first positioner 45A and the second joining portion 48 together with the two second positioners 48A forms an L-shape. Such configuration facilitates arrangement of the first positioner 45A between the two second positioners 48A in the placement process. Consequently, in the placement process, positioning of the first and second members 43, 46 is more easily performed.

(2) Further, in the folding process, the first positioner 45A and/or the two second positioners 48A is/are folded to overlap with the joining portions. In such configuration, it is possible to reduce hindrance to works, such as manufacturing of the purification device 1 or attachment of the purification device 1, that is caused by the first positioner 45A and/or the two second positioners 48A.

(3) Furthermore, in the joining process, two or more joining portions are swaged with the first positioner 45A and/or the two second positioners 48A that are folded to overlap with those joining portions. Thus, the first and second members 43, 46 are appropriately joined together.

(4) The insulator 4 of the purification device 1 in the above-described embodiments is formed by swaging two or more joining portions. Because of this, it is easier to adjust the interspace between the insulator 4 and the catalyst case 2, and it is possible to appropriately adjust a packing density of the heat insulating material 3 between the insulator 4 and the catalyst case 2. Consequently, it is possible to have the heat insulating material 3 provide a sufficient repulsive force and to fix the insulator 4 and the heat insulating material 3 to the catalyst case 2 without using any bolt or nut.

Moreover, because of no use of any bolt or nut, it is possible to reduce the number of components and to downsize the purification device 1. Therefore, lightweight of the purification device 1 can be realized, and ease of mounting the purification device 1 to a vehicle can be improved.

Other Embodiments (1) The exhaust component in the first to third embodiments is configured as the purification device 1 configured to purify the exhaust gas, in one example, with the use of the catalyst. However, the purification device 1 may be configured to use a substance other than the catalyst to purify the exhaust gas. Moreover, an insulator configured as described in the above-described embodiments may be provided in, for example, an exhaust component besides the purification device 1, such as a muffler or an exhaust pipe. Furthermore, an exhaust component provided with such an insulator can be manufactured by using the manufacturing method as described in the above-described embodiments.

(2) In the second embodiment, the second joining portion 48 may be provided, not with the slit 48B, but with a notch formed on the end opposite to the main body. In other words, at the end, there may be a portion formed in depressing manner toward the main body.

In the placement process, the first positioner 45A may be arranged at the notch of the second joining portion 48 so as to project from the surface of the second joining portion 48 opposite to the first joining portion 45. With such configuration, in the second joining portion 48, two portions located on both sides of the notch in the direction of the axis A function as the second positioners, and the first positioner 45A is situated between the second positioners.

In the subsequent folding process, as in the second embodiment, each first positioner 45A may be folded toward the main body. Likewise, in the subsequent joining process, as in the second embodiment, the two joining portions and the first positioner 45A that overlap with one another may be swaged together to join the first and second members 43, 46.

(3) In the third embodiment, the first joining portion 45 may be provided, not with the two slits 45B, but with two notches formed at the end opposite to the main body. In other words, at the end, there may be two portions formed in depressing manner toward the main body.

In the placement process, the two second positioners 48A may be arranged at these notches of the first joining portion 45 so as to project from the surface of the first joining portion 45 opposite to the second joining portion 48. With such configuration, in the first joining portion 45, a portion between the notches functions as the first positioner, and the first positioner is situated between the second positioners 48A.

Furthermore, in the subsequent folding process, as in the third embodiment, each second positioner 48A may be folded toward the main body. Likewise, in the subsequent joining process, as in the third embodiment, the two joining portions and the two second positioners 48A that overlap with one another may be swaged together to join the first and second members 43, 46.

(4) In the method for manufacturing the purification device in the aforementioned embodiments, the folding process may be omitted, and, in the joining process, the first and second joining portions 45, 48 that are arranged to overlap with each other in the placement process may be swaged together to join the first and second members 43, 46.

Additionally, the folding process may be performed after the placement process and the joining process are performed. Specifically, the first and second joining portions 45, 48 arranged to overlap with each other in the placement process may be swaged together in the joining process to join the first and second members 43, 46. Then the folding process may be performed in which the positioners are folded toward the main body to overlap with the first and second joining portions 45, 48 that are swaged at the positioners.

(5) Two or more functions achieved by one element in the aforementioned embodiment may be achieved by two or more elements; and one function achieved by one element may be achieved by two or more elements. Two or more functions achieved by two or more elements in the aforementioned embodiment may be achieved by one element; one function achieved by two or more elements may be achieved by one element. A part of the configuration of the aforementioned embodiment may be omitted. At least a part of the configuration of the aforementioned embodiment may be added to or redisposed with other configurations of the aforementioned embodiment.

What is claimed is:

1. A method for manufacturing an automotive exhaust component, the method comprising:

arranging first and second members so as to be located on both sides of a flow path member, the first and second members each having a plate shape and being included in an insulator that surrounds the flow path member, the flow path member extending along an axial line and being provided with a path for exhaust gas therein; and joining the first and second members, wherein the first member includes:

a first main body that is arranged to face an outer-circumferential surface of the flow path member;

a first joining portion having a flange shape that is provided at an end of the first main body in a circumferential direction about the axial line; and a first positioner provided to the first joining portion, wherein the second member includes:

a second main body that is arranged to face the outer-circumferential surface of the flow path member;

a second joining portion having a flange shape that is provided at an end of the second main body in the circumferential direction; and two second positioners that are provided to the second joining portion and aligned in a direction of the axial line, wherein, once the first and second members are in position, the first joining portion faces the second joining portion, and the first positioner is situated between the two second positioners, wherein the first and second joining portions are swaged with each other, and the first and second members are thus joined, and wherein the first positioner is provided at an end of the first joining portion opposite to the first main body and has a plate shape protruding toward the second joining portion.

2. The method for manufacturing an automotive exhaust component according to claim 1, wherein the two second positioners are provided at an end of the second joining portion opposite to the second main body, and each has a plate shape protruding toward the first joining portion.

3. The method for manufacturing an automotive exhaust component according to claim 2, the method further comprising folding the first positioner and the two second positioners toward the first and second main bodies after the first and second members are arranged, so as to overlap with the first and second joining portions.

4. The method for manufacturing an automotive exhaust component according to claim 3, wherein, when the first and second members are joined together, the first and second joining portions are swaged with the folded first positioner and the two folded second positioners.

5. The method for manufacturing an automotive exhaust component according to claim 1, the method further comprising folding the first positioner toward the first and second main bodies after the first and second members are arranged, so as to overlap with the first and second joining portions.

6. The method for manufacturing an automotive exhaust component according to claim 5, wherein, when the first and second members are joined together, the first and second joining portions are swaged with the folded first positioner.

7. A method for manufacturing an automotive exhaust component, the method comprising:

arranging first and second members so as to be located on both sides of a flow path member, the first and second members each having a plate shape and being included in an insulator that surrounds the flow path member, the flow path member extending along an axial line and being provided with a path for exhaust gas therein; and joining the first and second members, wherein the first member includes:

a first main body that is arranged to face an outer-circumferential surface of the flow path member;

a first joining portion having a flange shape that is provided at an end of the first main body in a circumferential direction about the axial line; and a first positioner provided to the first joining portion, wherein the second member includes:

a second main body that is arranged to face the outer-circumferential surface of the flow path member;

a second joining portion having a flange shape that is provided at an end of the second main body in the circumferential direction; and two second positioners that are provided to the second joining portion and aligned in a direction of the axial line, wherein, once the first and second members are in position, the first joining portion faces the second joining portion, and the first positioner is situated between the two second positioners, wherein the first and second joining portions are swaged with each other, and the first and second members are thus joined, and wherein the two second positioners are provided at an end of the second joining portion opposite to the second main body, and each has a plate shape protruding toward the first joining portion.

8. The method for manufacturing an automotive exhaust component according to claim 7, the method further comprising folding the two second positioners toward the first and second main bodies after the first and second members are arranged, so as to overlap with the first and second joining portions.

9. The method for manufacturing an automotive exhaust component according to claim 8, wherein, when the first and second members are joined together, the first and second joining portions are swaged with the two folded second positioners.

* * * * *